US006129772A

United States Patent [19]

Weers et al.

[11] Patent Number: 6,129,772

[45] Date of Patent: Oct. 10, 2000

[54] COMPOSITION AND METHOD TO IMPROVE LUBRICITY IN FUELS

[75] Inventors: Jerry J. Weers, Richmond; Weldon J. Cappel, Jr., Houston; David R. Gentry, Missouri City; Andrew J. McCallum, Katy, all of Tex.

[73] Assignee: Baker Hughes Incorporated, Houston, Tex.

[21] Appl. No.: 09/228,941

[22] Filed: Jan. 12, 1999

Related U.S. Application Data

[60] Provisional application No. 60/071,025, Jan. 13, 1998.

[51] Int. Cl.[7] ..... C01L 1/18

[52] U.S. Cl. ..... 44/385; 44/404

[58] Field of Search ..... 44/385, 404

[56] References Cited

U.S. PATENT DOCUMENTS

| | | | |
|---|---|---|---|
| 2,852,353 | 9/1958 | Craig et al. | 44/56 |
| 2,862,800 | 12/1958 | Cantrell et al. | 44/66 |
| 3,561,936 | 2/1971 | Eckert | 44/58 |
| 3,667,152 | 6/1972 | Eckert | 44/385 |
| 4,177,768 | 12/1979 | Davis | 123/1 A |
| 4,185,594 | 1/1980 | Perilstein | 44/385 |
| 4,204,481 | 5/1980 | Malec | 123/1 A |
| 4,214,876 | 7/1980 | Garth et al. | 44/66 |
| 4,227,889 | 10/1980 | Perilstein | 44/385 |
| 4,230,588 | 10/1980 | Bonazza et al. | 252/51.5 |
| 4,248,182 | 2/1981 | Malec | 123/1 A |
| 4,565,547 | 1/1986 | Takada | 44/385 |
| 5,284,492 | 2/1994 | Dubin | 44/301 |
| 5,591,237 | 1/1997 | Bell | 44/325 |

FOREIGN PATENT DOCUMENTS

| | | |
|---|---|---|
| 0476196 | 3/1992 | European Pat. Off. . |
| 0482253 | 4/1992 | European Pat. Off. . |
| 0780460 | 6/1997 | European Pat. Off. . |
| 2102439 C1 | 8/1996 | Russian Federation . |
| 503100 | 3/1971 | Switzerland . |
| 9417160 | 4/1994 | WIPO . |
| 9638518 | 12/1996 | WIPO . |

OTHER PUBLICATIONS

*Chemical Abstracts* Web Site Abstract of U.S. Pat. No. 4,250,045; Feb. 10, 1981.

M. Booth, et al., "Severe Hydrotreating of Diesel Can Cause Fuel–Injector Pump Failure," *Oil & Gas Journal*, Aug. 16, 1993, pp. 74–75.

K. Mitchell, "The Lubricity of Winter Diesel Fuels—Part 3: Further–Injector Pump Rig Tests," Society of Automotive Engineers, Inc., 1996, pp. 19–29.

N. C. Blizard, et al., "A Comparison of Modified Elevated Temperature HFRR Test Data with Scuffing BOCLE Results," Society of Automotive Engineers, Inc., 1996, pp. 31–50.

P. Saikkonen, et al., "Lubricity of Reformulated Diesel Fuel—Experience in Finland," Society of Automotive Engineers, Inc., 1996, pp. 51–57.

R. J. Batt, et al., "Lubricity Additives—Performance and No–Harm Effects in Low Sulfur Fuels," Society of Automotive Engineers, Inc., 1996, pp. 9–17.

"Diesel Fuel Lubricity—An Update," *Paramins Post*, May, 1997.

Derwent Abstract of EP 745115–A1, Week 9702.

*Primary Examiner*—Jacqueline V. Howard

*Attorney, Agent, or Firm*—Madan, Mossman & Sriram, P.C.

[57] ABSTRACT

It has been discovered that compositions which are blends or mixtures including a monomeric fatty acid component can serve as stable lubricity additives in distillate fuels, including gasoline. The compositions may include saturated or unsaturated, monomeric fatty acids having from 12 to 22 carbon atoms; a synthetic monomeric acids having from 12 to 40 carbon atoms; and saturated or unsaturated, oligomeric fatty acids having from 24 to 66 carbon atoms. Where a saturated monomeric fatty acid is used, a hindered and/or tertiary amine may be present as a stabilizer.

45 Claims, 4 Drawing Sheets

COMPOSITION AND METHOD TO IMPROVE LUBRICITY IN FUELS

This application claims the benefit of U.S. Provisional Application No. 60/071,025 filed Jan. 13, 1998.

FIELD OF THE INVENTION

The present invention relates to lubricity additives for distillate fuels, and more particularly relates, in one embodiment to lubricity additives for hydrocarbon fuels, where the additives comprise mixtures of monomeric and polymeric fatty acids.

BACKGROUND OF THE INVENTION

It is well known that in many engines the fuel is the lubricant for the fuel system components, such as fuel pumps and injectors. Many studies of fuels with poor lubricity have been conducted in an effort to understand fuel compositions which have poor lubricity and to correlate lab test methods with actual field use. The problem is general to diesel fuels, kerosene and gasolines, however, most of the studies have concentrated on the first two hydrocarbons.

Previous work has shown that saturated, monomeric and dimeric, fatty acids of from 12 to 54 carbon atoms used individually give excellent performance as fuel lubricity aids in diesel fuels. While these materials show excellent lubricity properties, they are often difficult to formulate into products due to their poor solubility in hydrocarbons and fatty acid mixtures. Commercial product TOLAD® 9103 Fuel Lubricity Aid sold by Baker Petrolite Corporation only contains approximately 3.8 weight %, stearic acid (a saturated monomeric fatty acid) in a specific and complex mixture of unsaturated monomeric and unsaturated oligomeric fatty acids and heavy aromatic solvent. It has performance characteristics better than products which do not contain the high levels of these saturated acids. However, levels of stearic acid higher than 3.8% tend to separate from the product on standing which limits their usefulness as additives. Simply increasing the stearic acid proportion in TOLAD 9103 Fuel Lubricity Aid above about 3.8% results in an unstable product.

SUMMARY OF THE INVENTION

Accordingly, it is an object of the present invention to provide fuel lubricity additives which improves lubricity over conventional additives.

It is another object of the present invention to provide fuel lubricity additives which improves lubricity over conventional additives, and are stable.

Another object of the invention is to provide fuel lubricity additives which improves lubricity in gasoline, which have not heretofore employed lubricity additives.

In carrying out these and other objects of the invention, there is provided, in one form, a composition for improving the lubricity of distillate fuels which has (a) at least one monomeric fatty acid component which may be either
a $C_{12}$–$C_{22}$ saturated, monomeric fatty acid;
an $C_{12}$–$C_{22}$ unsaturated, monomeric fatty acid; or
a $C_{12}$–$C_{40}$ synthetic monomeric fatty acid; and (b) at least one oligomeric fatty acid component which may be either
a $C_{24}$–$C_{66}$ saturated, oligomeric fatty acid; and
an $C_{24}$–$C_{66}$ unsaturated, oligomeric fatty acid.

DETAILED DESCRIPTION OF THE INVENTION

Figure 1:
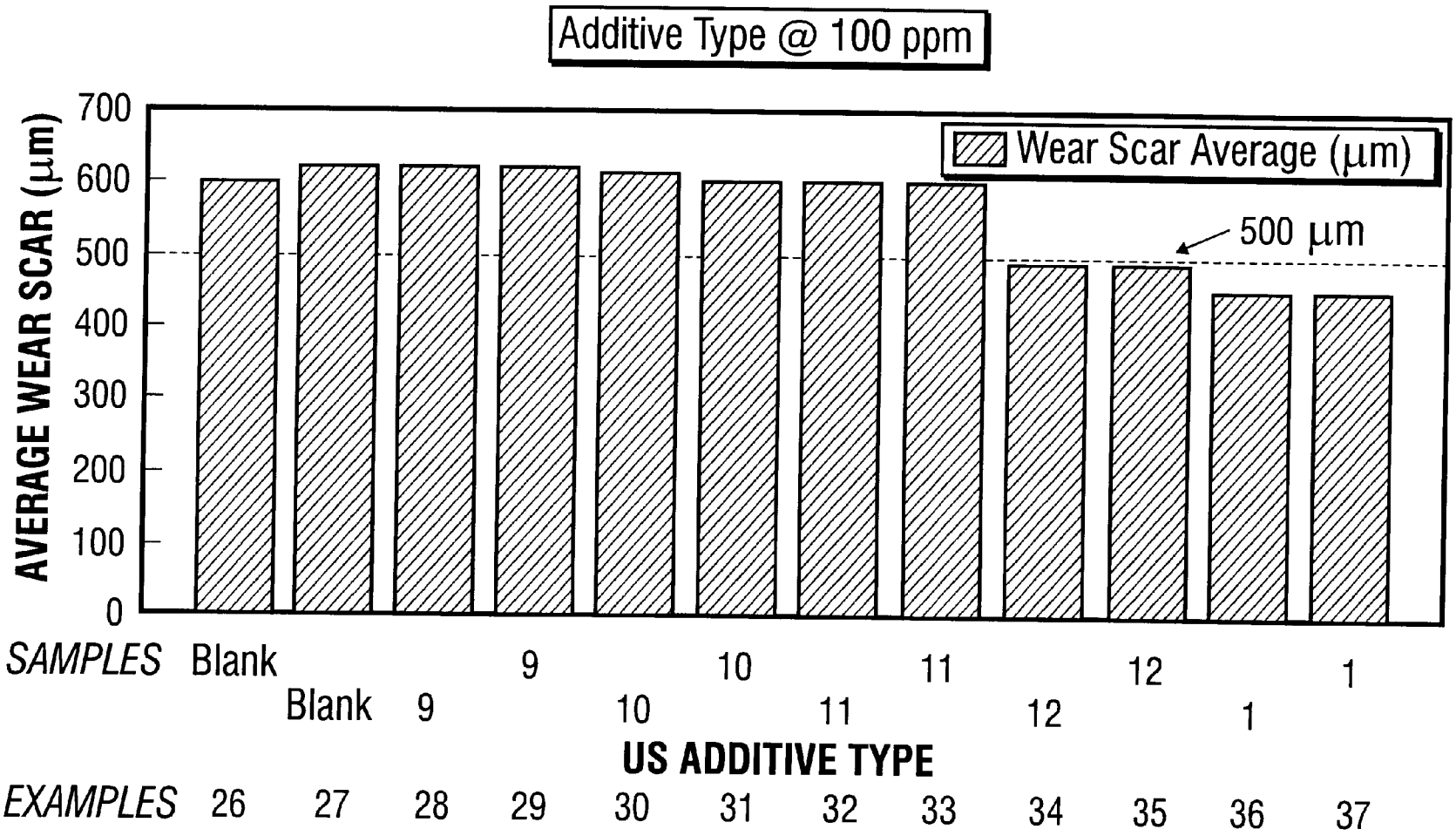
FIG. 1 is a chart of the results of wear scar testing of various lubricity aids at 100 ppm.

New compositions have been discovered which are useful as fuel lubricity aids, and which may contain, in some embodiments, higher amounts of saturated monomeric (e.g. stearic acid) and oligomeric fatty acids. Customarily, lubricity aids have been limited to use in diesel fuels used in diesel engines having distributors and rotary type fuel injection pumps which rely totally on the fuel for lubrication. Gasoline engines, having a different design with different requirements have not required lubricity aids, but it has been unexpectedly discovered herein that gasolines and gasoline engines benefit from the lubricity aids of the invention, which would not have been expected due to the different structure and design of a gasoline engine.

The invention relates to lubricity additives for distillate fuels, as contrasted with products from resid. In the context of this invention, distillate fuels include, but are not necessarily limited to diesel fuel, kerosene, gasoline and the like. It will be appreciated that distillate fuels include blends of conventional hydrocarbons meant by these terms with oxygenates, e.g. alcohols, such as methanol, and other additives or blending components presently used in these distillate fuels, such as MTBE (methyl-tert-butyl ether) or used in the future.

Generally, in one embodiment of the invention the composition for improving the lubricity of distillate fuels is a mixture or blend of at least one monomeric fatty acid component with at least one oligomeric fatty acid component, and in another embodiment is a mixture or blend of at least one saturated, monomeric fatty acid with an amine.

The monomeric fatty acid components may be a saturated, monomeric fatty acid having from 12 to 22 carbon atoms, an unsaturated, monomeric fatty acid having from 12 to 22 carbon atoms, or a synthetic monomeric fatty acid having from 12 to 40 carbon atoms. In one general embodiment of the invention, a synthetic monomeric fatty acid is any monomeric fatty acid within the given carbon number range that does not occur in nature. In one non-limiting embodiment of the invention, a synthetic monomeric fatty acid is one that results from the modification of a natural fatty acid by a process including, but not limited to, alkylation, hydrogenation, arylation, isomerization or combinations of these modifications. In another, non-limiting embodiment of the invention, the synthetic monomeric fatty acid is formed by dimerizing any of the unsaturated, monomeric fatty acids having from 12 to 22 carbon atoms mentioned above, and then hydrogenating them.

Specific examples of suitable saturated, monomeric fatty acids include, but are not limited to, lauric acid (dodecanoic acid); myristic acid (tetradecanoic acid); palmitic acid (hexadecanoic acid); stearic acid (octadecanoic acid); and the like. Specific examples of suitable unsaturated, monomeric fatty acids include, but are not limited to, oleic acid (cis-9-octadecenoic acid); tall oil fatty acid (e.g. Westvaco L-5); and the like. Specific examples of suitable synthetic, monomeric fatty acids include, but are not limited to, Union Camp Century 1105 and the like.

The oligomeric fatty acid components may be a saturated, oligomeric fatty acid having from 24 to 66 carbon atoms, or an unsaturated, monomeric fatty acid having from 24 to 66 carbon atoms. In one general embodiment of the invention, the oligomeric fatty acids may be made by dimerizing or trimerizing any of the unsaturated monomeric acids suitable for the monomeric fatty acid component described above.

Specific examples of suitable saturated, oligomeric fatty acids include, but are not limited to, dimer acid (Unichema Pripol 1009); and the like. Specific examples of suitable unsaturated, oligomeric fatty acids include, but are not limited to, dimer acid (e.g. Westvaco DTC-595); trimer acid (e.g. Westvaco DTC-195); and the like.

In one embodiment of the invention it is preferred that the oligomeric fatty acid component be a dimer, although trimers are acceptable. In another embodiment of the invention, it is preferred that the monomeric fatty acid component comprise from about 4 to about 90 weight % of the total composition, preferably from about 4 to about 50 wt. % of the total, most preferably from about 4 to about 15 or 10 wt. % of the total. Of course, in one embodiment of the invention, the monomeric fatty acid component is 100% of the total composition of acids. In another embodiment of the invention, the lower limit of these ranges is 5 wt. %.

The stable compositions which have been discovered include, but are not necessarily limited to:

1. Mixtures of at least one pure, saturated, monomeric, fatty acid with at least one pure, saturated, oligomeric fatty acid. One specific, non-limiting example of this embodiment of the invention includes, but is not limited to:
   In Example 169, a 75% of a blend of 65:10 Unichemica PRIPOL® 1009 hydrogenated dimer acid/palmitic acid gave a wear scar value of 274 microns. (Percentages herein should be understood to be weight percentages unless otherwise noted. Ratios herein should be understood to be weight ratios unless otherwise noted.)
2. Mixtures of at least one pure, saturated, monomeric, fatty acid with at least one pure, unsaturated, oligomeric fatty acid. Specific, non-limiting examples of this embodiment of the invention include, but are not limited to:
   In Example 170, a 75% blend of 65:10 Westvaco DTC-595/palmitic acid gave a wear scar value of 382 microns.
   In Example 171, a 75% blend of 65:10 Westvaco DTC-595/palmitic acid gave a wear scar value of 363 microns.
3. Mixtures of at least one pure, unsaturated, monomeric, fatty acid with at least one pure, saturated, oligomeric fatty acid. One specific, non-limiting example of this embodiment of the invention includes, but is not limited to:
   In Example 165, a 75% of a blend of 50:50 Unichemica PRIPOL® 1009 hydrogenated dimer acid/Westvaco L-5 gave a wear scar value of 428 microns.
4. Mixtures of at least one pure, unsaturated, monomeric, fatty acid with at least one pure, unsaturated, oligomeric fatty acid. One specific, non-limiting example of this embodiment of the invention includes, but is not limited to:
   In Example 166, a 75% of a blend of 50:50 Westvaco DTC-595/Westvaco L-5 gave a wear scar value of 496 microns.
5. Mixtures of at least one pure, saturated, monomeric, fatty acid with an amine and, optionally, at least one pure, saturated or unsaturated, oligomeric fatty acid.
   Specific, non-limiting examples of this embodiment of the invention include, but is not limited to, the following combinations of monomeric acid component with amine (without including an oligomeric acid component, which should be understood as present):
   In Example 172, a 75% of a blend of 44:31 stearic acid/RohMax Primene 81R® gave a wear scar value of 299 microns.
   Pure stearic acid+tri-n-butylamine(aliphatic tertiary amine).
   Pure stearic acid+CS1246® (heterocyclic amine).
   Pure stearic acid+alkyl pyridine(heterocyclic amine).
   Pure stearic acid+N,N-di-n-butylethylenediamine (polyamine).
   Pure stearic acid+TOMAH E-17-2® (oxyalkylated amine).
6. Mixtures of at least one synthetic monomeric acid with at least one pure, saturated or unsaturated, oligomeric fatty acid. Specific, non-limiting examples of this embodiment of the invention include, but are not limited to:
   In Example 167, a 75% of a blend of 50:50 Unichema Pripol 1009/Union Camp Century gave a wear scar value of 236 microns.
   In Example 168, a 75% of a blend of 50:50 Westvaco DTC-195/Union Camp Century gave a wear scar value of 378 microns.
   A blend of pure isostearic acid with Westvaco 1500, a pure, unsaturated, oligomeric fatty acid.

In one non-limiting embodiment of the invention, the composition for improving the lubricity of distillate fuels of invention excludes mixtures of a saturated, monomeric fatty acid having from 12 to 22 carbon atoms with an unsaturated, monomeric fatty acid having from 12 to 22 carbon atoms. Also excluded would be mixtures of a saturated, oligomeric fatty acid having from 24 to 66 carbon atoms with an unsaturated, oligomeric fatty acid having from 24 to 66 carbon atoms, in another non-limiting embodiment of the invention.

In a broad embodiment of the invention, the suitable stabilizing amine is any inert amine, i.e. an amine which does not react with the acids present to form an amide. In another embodiment of the invention, the amine is a tertiary amine or an amine where the carbon adjacent the amine nitrogen contains no hydrogen atoms (e.g. t-butyl amine). In another embodiment of the invention, the amine may be an amine having at least one amine functional group selected from the group consisting of primary aliphatic amines, secondary aliphatic amines, tertiary aliphatic amines, cycloaliphatic amines, heterocyclic amines, aromatic amines (e.g. aniline), and oxyalkylated amines. Heterocyclic amines in the context of this invention encompass multiple structures which include, but are not necessarily limited to, structures such as pyridines, pyrimidines, and imidazoles.

In one preferred embodiment of the invention, the ratio of amine to acid is near molar equivalent; that is, near stoichiometric. In another embodiment of the invention, the ratio of amine to at least one pure, saturated, monomeric, fatty acid ranges from about 1 part amine to 9 parts acid to about 9 parts amine to 1 part acid, by weight. In another embodiment the molar equivalent ratio proportion of amine to saturated monomeric fatty acid in the total composition ranges from about 0.1:1 to about 1:1. Optionally, the amine/monomer mixture may comprise from 100% to 1% of the mixture with the oligomeric fatty acid. The optional amine component in approximate stoichiometric equality with the monomer component permits the composition to be more stable with higher proportions of monomer. In one non-limiting explanation of how the amines impart stability, it is believed that the amines prevent the saturated monomeric fatty acids from reacting. The optional amine component preferably contains from about 4 to about 36 carbon atoms.

Typically, a solvent is preferably used in the compositions of the invention, where the solvent may be aromatic solvents and pure paraffinic solvents. Aromatic solvents are particularly preferred. The proportion of solvent in the total fuel lubricity aid composition ranges from about 0 to 50 weight %. The use of a solvent is optional. Specific examples of suitable solvents include, but are not limited to, aromatic naphtha; kerosene; diesel; gasoline; xylene; toluene; and the like.

The term "pure" is used in the specification herein to means essentially none of another component, as far as such a component is commercially available. With respect to a saturated acid, "pure" means essentially no unsaturated material is present, and vice versa. For example, "pure" commercially available stearic acid is free from oleic acid. When the term "only one" is employed, it is meant that the respective one monomeric fatty acid component be essentially the only monomeric fatty acid present, and the one oligomeric fatty acid component is essentially the only oligomeric fatty acid present. In one particularly preferred embodiment of the invention, the composition consists of just a single pure monomeric fatty acid component, and just a single pure oligomeric fatty acid component. It has been unexpectedly discovered that the particularly exemplified combinations of a monomeric fatty acid component, and an oligomeric fatty acid component give better results than complex mixtures of saturated and unsaturated monomeric fatty acids and oligomers, for example, TOLAD® 9103 lubricity aid sold by Baker Petrolite Corporation, which is a complex mixture of saturated and unsaturated monomeric fatty acids and oligomers having about 3.8%, of a particular fatty acid (stearic acid).

As noted, the compositions of this invention can be used in various distillate hydrocarbon fuels in concentrations effective to improve the lubricity thereof including, but not necessarily limited to diesel fuel, kerosene or gasoline. Concentrations of the above compositions in hydrocarbons to improve lubricity thereof range from about 10 to about 400 ppm, preferably from about 10 to about 200 ppm, and most preferably from about 25 to about 100 ppm.

The invention will be illustrated further with respect to the following non-limiting Examples which are to further illuminate the invention only.

EXAMPLE 1

A Mixture of a Single Pure, Saturated, Monomeric, Fatty Acid With an Aliphatic Amine To a 100 cc vessel were charged 28.4 g (0.1 mole) stearic acid and 19.5 g (0.1 mole) PRIMENE 81R and mixed to give Sample 1. In one embodiment of this invention, this mixture was diluted 30% by weight with Solvent 14 (aromatic naphtha solvent) This is an example using 100% pure, saturated, monomeric, fatty acid with an amine.

EXAMPLES 2–25

Samples 2 through 8 were prepared according to Example 1, except that proportions of the acids and amines shown Table I were used. Table I presents Wear Scar Diameter (WSD) results conducted according to the procedure used in the BOTD Test (Ball on Three Disc Test) developed by Falex Corporation, for Samples 1–8 as well as some commercial lubricity aids such as TOLAD® 9103 (T-9103). All runs in Table I were at the indicated doses in Shell P-50 Diesel—except where the hydrocarbon fuel is indicated as Kero (kerosene) or SW-1 (Swedish Class 1 diesel). It can be readily seen that Inventive Sample 1 gives one of the lowest WSD results of all twenty-four examples.

In Example 18, Sample 8, the ratio of HOAc to CRO-111 is 7.5 wt. % HOAc to 92.5 wt. % CRO-111 by weight. Both components were weighed into a bottle and shaken. Solubility was complete at ambient temperature. Stability was tested by adding 1 drop deionized water to a 2.0 g sample and heating overnight. Any solids formed was noted. Sample 8 stayed solids free.

TABLE I

Comparative WSD Results

| Ex. | Sample # | Description | Dose, ppm | WSD, mm |
|---|---|---|---|---|
| 2 | 2 | Xylylstearic acid + AEAE | 100 | 0.3208 |
| 3 | 3 | Xylylstearic acid + DEA | 100 | 0.2842 |
| 4 | 4 | Ricinoleic acid + AEAE | 100 | 0.2742 |
| 5 | 5 | Dimer acid (T-9103) + DEA | 100 | 0.2925 |
| 6 | 6 | Ricinoleic acid + DEA | 100 | 0.2975 |
| 7 | 7 | Hamposil O + DEA | 100 | 0.2733 |
| 8 | | Witcamide 5138 | 200 | 0.2125 |
| 9 | | " | 100 | 0.3242 |
| 10 | | " | 25 | 0.3841 |
| 11 | | " | 25 | 0.2050 |
| 12 | | CRO-111 | 25 | 0.3258 |
| 13 | | CRO-290 | 25 | 0.4467 |
| 14 | | CRO-111 (Kero) | 25 | 0.1858 |
| 15 | | CRO-290 (Kero) | 25 | 0.2658 |
| 16 | | Hamposil O | 100 | 0.2658 |
| 17 | | Hamposil C | 100 | 0.3075 |
| 18 | 8 | CRO-111/HOAc | 25 | 0.4792 |
| 19 | 1 | Stearic acid + Primene 91R | 100 | 0.2650 |
| 20 | | T-9103 | 100 | 0.3192 |
| 21 | | " | " | 0.3417 |
| 22 | | " | " | 0.2433 |
| 23 | | T-9103 (SW-1) | 50 | 0.3492 |
| 24 | | T-9103 (SW-1) | 100 | 0.2733 |
| 25 | | T-9103 (SW-1) | 200 | 0.2692 |

EXAMPLES 26–37

Samples 1 and 9 through 12 were tested at 100 ppm doses in Class 1 Diesel according to ASTM-6079 High Frequency Reciprocating Rig (HFRR) at 60° C. The results are presented in Table II and charted in FIG. 1. In this testing the Inventive Sample 1 composition gave the best results of any compositions tested. Usually, a level of 450 $\mu$m or below is considered a "good" WSD value to have for a fuel, although some areas use a 460 $\mu$m level.

TABLE II

Wear Scar Testing of Various Lubricity Aids at 100 ppm

| Ex. | Sample | Wear Scar Average ($\mu$m) | Description |
|---|---|---|---|
| 26 | Blank | 600 | |
| 27 | Blank | 620 | |
| 28 | 9 | 617 | Oleic Acid/Propane Diamine Diamide |
| 29 | 9 | 614 | Oleic Acid/Propane Diamine Diamide |
| 30* | 10 | 611 | Oleic Acid/Propane Diamine |
| 31* | 10 | 598 | Oleic Acid/Propane Diamine |

TABLE II-continued

Wear Scar Testing of Various Lubricity Aids at 100 ppm

| Ex. | Sample | Wear Scar Average (μm) | Description |
|---|---|---|---|
| 32 | 11 | 593 | Xylylstearic Acid/Propane Diamine Diamide |
| 33 | 11 | 599 | Xylylstearic Acid/Propane Diamine Diamide |
| 34 | 12 | 485 | CRO-11 + Acetic Acid (92.5/7.5 Parts) |
| 35 | 12 | 488 | CRO-11 + Acetic Acid (92.5/7.5 Parts) |
| 36 | 1 | 451 | Stearic Acid/Primene 81R Amine |
| 37 | 1 | 447 | Stearic Acid/Primene 81R Amine |

*Due to the difference in reaction conditions from Examples 28 and 29, tetrahydropyrimidines were formed in these Examples.

EXAMPLES 38–47

Figure 2:
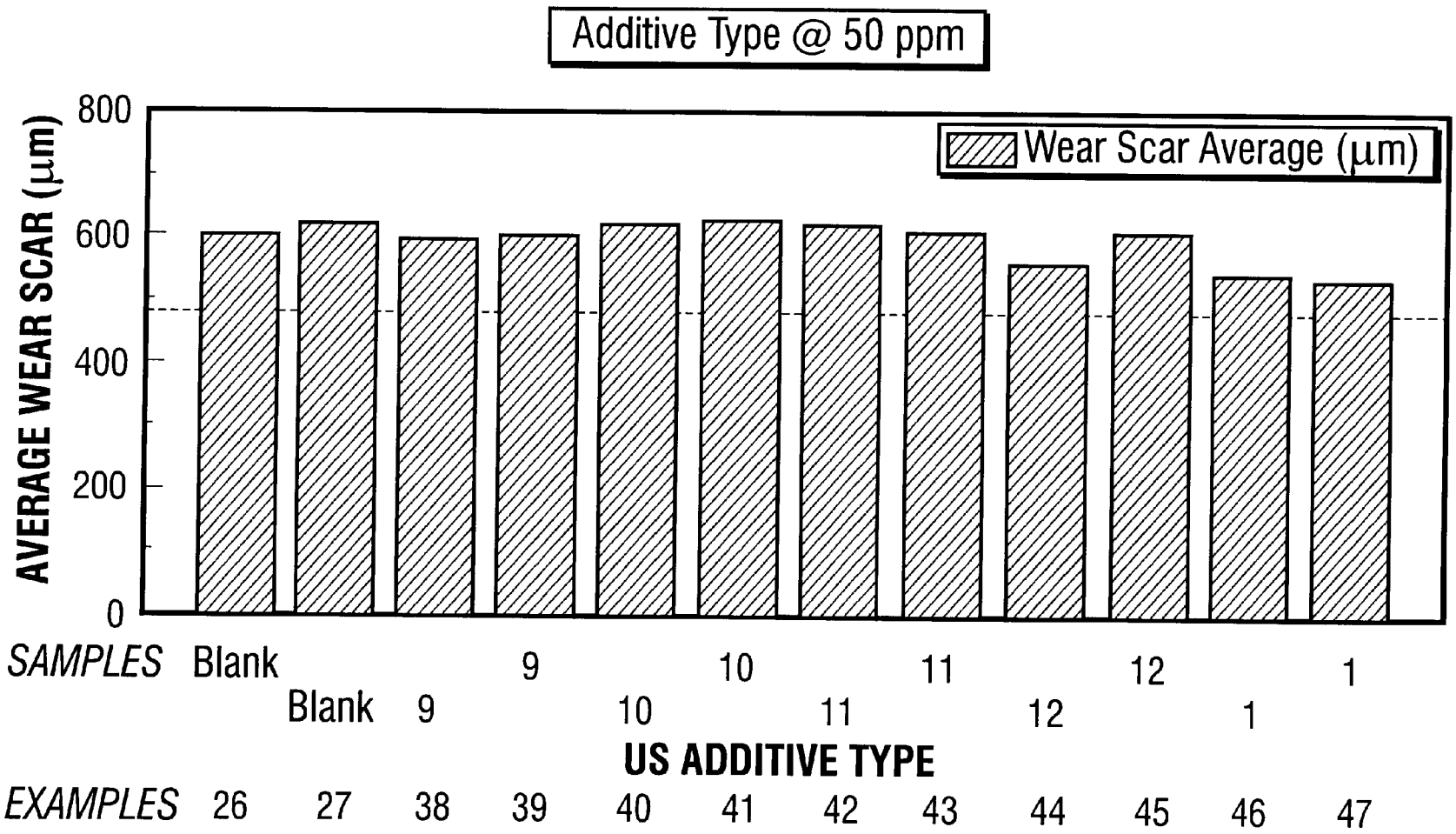
FIG. 2 is a chart of the results of wear scar testing of various lubricity aids at 50 ppm.

Samples 1 and 9 through 12 were tested at 50 ppm doses in Class 1 Diesel according to ASTM-6079 (HFRR). The results are presented in Table III and charted in FIG. 2. In this testing the Inventive Sample 1 composition once again gave the best results of any compositions tested.

TABLE III

Wear Scar Testing of Various Lubricity Aids at 50 ppm

| Ex. | Sample | Wear Scar Average (μm) | Description |
|---|---|---|---|
| 26 | Blank | 600 | |
| 27 | Blank | 620 | |
| 38 | 9 | 595 | Oleic Acid/Propane Diamine Diamide |
| 39 | 9 | 599 | Oleic Acid/Propane Diamine Diamide |
| 40* | 10 | 615 | Oleic Acid/Propane Diamine |
| 41* | 10 | 623 | Oleic Acid/Propane Diamine |
| 42 | 11 | 616 | Xylylstearic Acid/Propane Diamine Diamide |
| 43 | 11 | 607 | Xylylstearic Acid/Propane Diamine Diamide |
| 44 | 12 | 553 | CRO-11 + Acetic Acid (92.5/7.5 Parts) |
| 45 | 12 | 612 | CRO-11 + Acetic Acid (92.5/7.5 Parts) |
| 46 | 1 | 545 | Stearic Acid/Primene 81R Amine |
| 47 | 1 | 533 | Stearic Acid/Primene 81R Amine |

*Due to the difference in reaction conditions from Examples 38 and 39, tetrahydropyrimidines were formed in these Examples.

EXAMPLES 48–61

Figure 3:
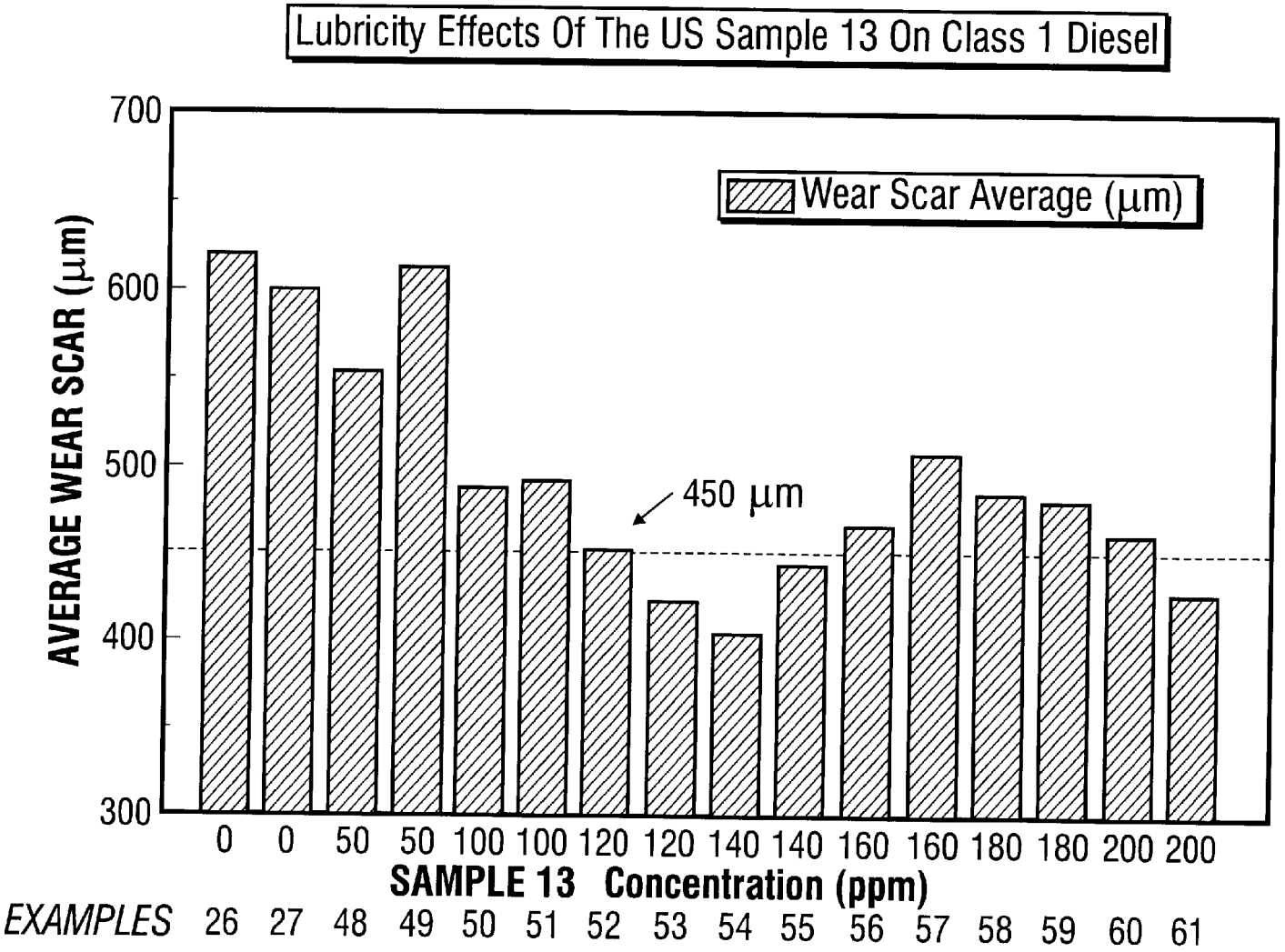
FIG. 3 is a chart of the results of wear scar testing of Sample 13 at various doses.

Sample 13 was tested at various doses in Class 1 Diesel according to ASTM-6079 HFRR. The results are presented in Table IV and charted in FIG. 3. Sample 13 was 92.5% CRO-111 and 7.5% HOAc, % w/w (the same composition as Ex. 18, Sample 8, and Ex. 44, Sample 12).

TABLE IV

Wear Scar Testing of Sample 13 at Various Doses

| Ex. | Dose | Wear Scar Average (μm) |
|---|---|---|
| 26 | 0 | 600 |
| 27 | 0 | 620 |
| 48 | 50 | 556 |
| 49 | 50 | 612 |
| 50 | 100 | 485 |
| 51 | 100 | 488 |
| 52 | 120 | 447 |
| 53 | 120 | 418 |
| 54 | 140 | 399 |
| 55 | 140 | 438 |

TABLE IV-continued

Wear Scar Testing of Sample 13 at Various Doses

| Ex. | Dose | Wear Scar Average (μm) |
|---|---|---|
| 56 | 160 | 462 |
| 57 | 160 | 502 |
| 58 | 180 | 480 |
| 59 | 180 | 476 |
| 60 | 200 | 455 |
| 61 | 200 | 423 |

EXAMPLES 62–75

Figure 4:
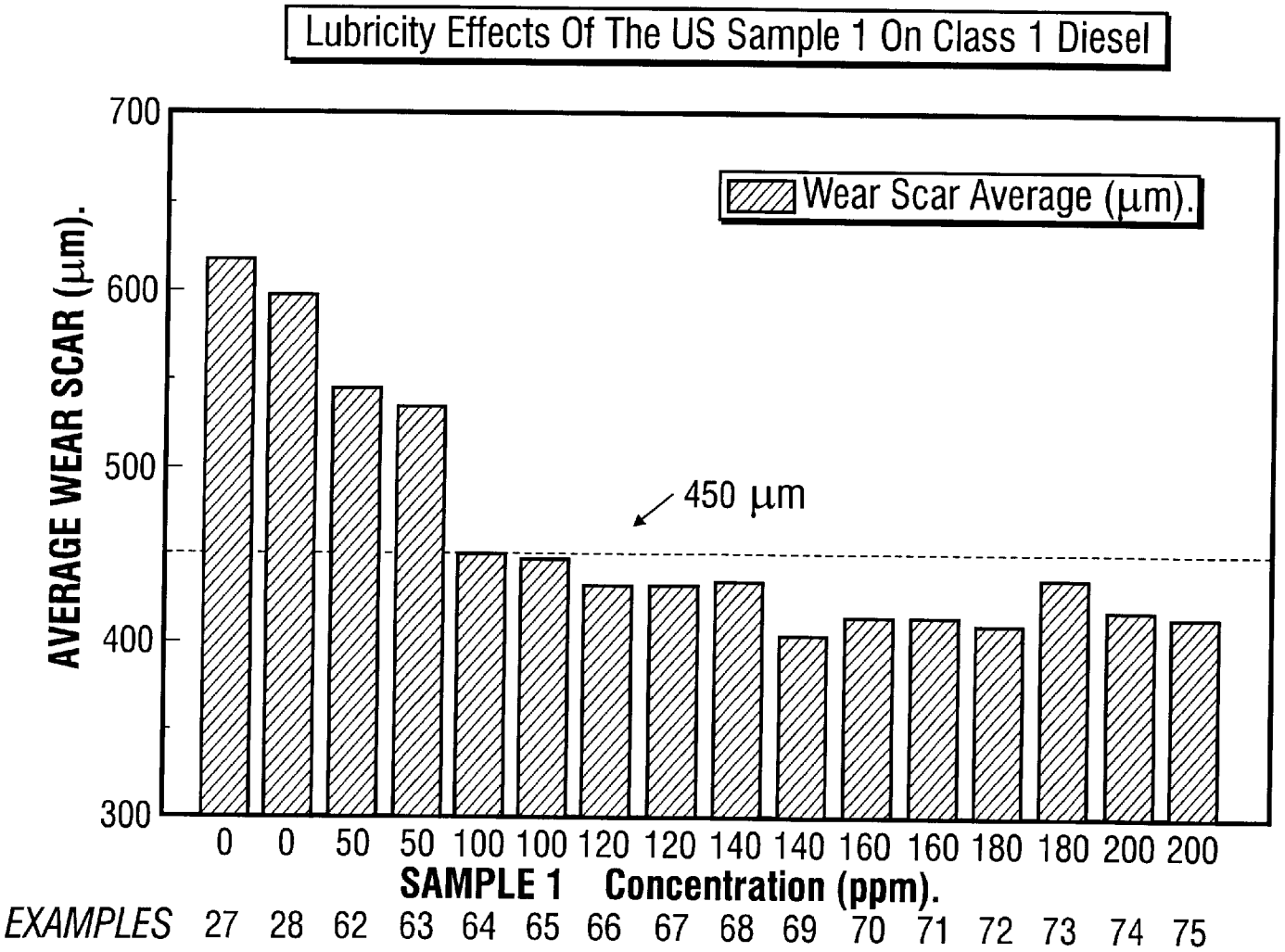
FIG. 4 is a chart of the results of wear scar testing of Sample 1 at various doses.

Sample 1 was tested at the same various doses in Class 1 Diesel as was Sample 13 in Examples 48–61; also according to ASTM-6079 HFRR. The results are presented in Table V and charted in FIG. 4. Again, a comparison of the results using Sample 1 v. Sample 13 (Tables V v. IV or FIGS. 4 v. 3) demonstrate that Sample 1 of this invention consistently gives better results at every dosage level.

TABLE V

Wear Scar Testing of Sample 1 at Various Doses

| Ex. | Dose | Wear Scar Average (μm) |
|---|---|---|
| 26 | 0 | 600 |
| 27 | 0 | 620 |
| 62 | 50 | 545 |
| 63 | 50 | 533 |
| 64 | 100 | 451 |
| 65 | 100 | 447 |
| 66 | 120 | 431 |
| 67 | 120 | 432 |
| 68 | 140 | 433 |
| 69 | 140 | 404 |
| 70 | 160 | 414 |
| 71 | 160 | 414 |
| 72 | 180 | 410 |
| 73 | 180 | 435 |
| 74 | 200 | 419 |
| 75 | 200 | 415 |

EXAMPLE 76

Solubility of Witco Stearic Acids in Pure Solvents

| | |
|---|---|
| 25 g | Total Sample Wt. |
| 2.5 g | Witco HYSTRENE ® 9718 Stearic Acid |
| 22.5 g | Ethyl Acetate |
| 10% | HYSTRENE 9718 by weight |

The components were placed into an empty prescription bottle. At 75° F. (24° C., room temperature), the stearic acid did not go into solution in the ethyl acetate. The stearic acid settled to the bottom of the test jar. Heating the sample to 120° F. (49° C.) for 15 minutes caused the stearic acid to be totally dissolved in the ethyl acetate. The sample was allowed to cool to room temperature. After 30 minutes, solids started to form. Overnight at room temperature, the sample turned cloudy with suspended particles.

EXAMPLE 77

Solubility of Stearic Acid in Acetic Acid

| | | |
|---|---|---|
| 25 | g | Total Sample Wt. |
| 1.25 | g | Witco HYSTRENE ® 9718 Stearic Acid |
| 23.75 | g | Acetic Acid |
| 5% | | HYSTRENE 9718 by weight |

The components were placed into an empty prescription bottle. At 75° F. (24° C., room temperature), the stearic acid would not dissolve in the acetic acid. The sample was placed in an 120° F. (49° C.) oven for 15 minutes. The sample totally dissolved at 120° F. (49° C.). The sample was allowed to cool to room temperature, whereupon the stearic acid dropped out.

EXAMPLE 78

Solubility of Stearic Acid in Valeric Acid (Saturated Monomer in Saturated Dimer)

| | | |
|---|---|---|
| 25 | g | Total Sample Wt. |
| 1.25 | g | Witco HYSTRENE ® 9718 Stearic Acid |
| 23.75 | g | Valeric Acid |
| 5% | | HYSTRENE 9718 by weight |

Stearic acid (5 wt. %) went into solution in valeric acid at room temperature. Additional stearic acid (1.5 g) was added to the mixture to make a total of 26.50 g containing 10.37 wt. % stearic acid. The 10 wt. % proportion would not blend into valeric acid at room temperature. When the sample was placed in 120° F. (49° C.) oven for 15 minutes, the stearic acid went into solution. The sample was allowed to cool to room temperature (75° F., 24° C.). The sample looked clear after cooling to room temperature. However after 2 hours at 75° F. (24° C.), the sample was frozen solid. More valeric acid (8.4 g) was added to the sample. This reduced the stearic acid proportion to 7.8 wt. %. The sample was heated to 120° F. (49° C.); all of the stearic acid was soluble in the valeric acid and allowed to cool to room temperature (75° F., 24° C.). After 24 hours at room temperature, the sample was clear.

EXAMPLE 79

Solubility of Stearic Acid in Unichemica PRIPOL 1009 Dimer Acid

| | | |
|---|---|---|
| 25 | g | Total Sample Wt. |
| 1.25 | g | Witco HYSTRENE ® 9718 Stearic Acid |
| 23.75 | g | PRIPOL 1009 Dimer Acid (extremely viscous) |
| 5% | | HYSTRENE 9718 by weight |

The sample was placed in a 120° F. (49° C.) oven to heat. The sample was slow to mix; a few particles were in suspension after 65 minutes. After 5 minutes in a 180° F. (82° C.) oven, all of the stearic acid dissolved into the dimer acid. The sample was allowed to cool to room temperature (75° F., 24° C.) and 1.5 g (approximately 5%) more stearic acid was added to make the total 10.37 wt. %. The sample was placed in a 180° F. (82° C.) oven to help solubilize the mixture. Upon cooling for an hour, the sample started clouding. The sample was reheated to 180° F. (82° C.) and 8.5 more grams of the dimer acid was added reducing the stearic acid proportion to 7.85 wt. %.

EXAMPLE 80

Solubility of Stearic Acid in Soybean Oil

| | | |
|---|---|---|
| 1.25 | g | Witco HYSTRENE ® 9718 Stearic Acid |
| + 23.75 | g | Soybean oil |
| 25 | g | Total Sample Wt. |

The sample was hazy at room temperature (75° F., 24° C.). The sample was placed in a 120° F. (49° C.) oven for about 25 minutes, but the stearic acid did not solubilize. Nor did the stearic acid solubilize after the sample was placed in a 180° F. (82° C.) oven.

EXAMPLE 81

Solubility of Stearic Acid in Unichemica PRIPOL 1013 Dimer Acid

| | | |
|---|---|---|
| 25 | g | Total Sample Wt. |
| 1.25 | g | Witco HYSTRENE ® 9718 Stearic Acid |
| 23.75 | g | PRIPOL 1013 Dimer Acid (extremely viscous) |

The sample was placed in a 180° F. (82° C.) oven to help solubilize the stearic acid in the viscous dimer acid.

EXAMPLE 82

Solubility of Saturated Monomer (Stearic Acid) in Saturated Ester (Exxate 1300 Solvent)

10 wt.% Witco HYSTRENE® 9718 Stearic Acid 90 wt.% Exxate 1300 Solvent

The sample at room temperature was cloug,20 dy white. The sample was placed in a 120° F. (49° C.) oven to help solubilize the stearic acid in the saturated ester, but solubility did not occur after 30 minutes. The sample was placed in a 180° F. (82° C.) oven and after 15 minutes all of the stearic acid was soluble. The sample was taken out of the oven and allowed to cool to 75° F. (24° C.). The sample froze at 75° F. (24° C.) indicating 10% stearic acid was not soluble. Additional solvent (5 g) was added which adjusted the total stearic acid proportion to 8.0 wt. %, and the sample was placed into a 180° F. (82° C.) oven. The sample was allowed to cool and the stearic acid dropped out.

EXAMPLE 83

Solubility of Saturated Monomer (Stearic Acid) in Aliphatic Primary Amine (Primene 81R)

| | | |
|---|---|---|
| 2 | g | (10 wt. %) Witco HYSTRENE ® 9718 Stearic Acid |
| 18 | g | Primene 81R |

At room temperature (75° F., 24° C.), the stearic acid dissolved. The stearic acid proportion was increased to 20 wt. % in a separate run:

| | |
|---|---|
| 4 g | (10 wt. %) Witco HYSTRENE ® 9718 Stearic Acid |
| 16 g | Primene 81R |

At room temperature (75° F., 24° C.), the stearic acid dissolved. This sample was allowed to sit at room temperature to see if settling occurs, and it did not. The 20 wt. % mixture of stearic acid in Primene 81R was tested to see how much (%) will be soluble in Pripol 1009 dimer acid:

| | |
|---|---|
| 10 g | Pripol Dimer Acid |
| 10 g | 20 wt. % stearic acid in Primene 81R |

The sample was placed in 120° F. (49° C.) oven, then a 180° F. (82° C.) oven for 30 minutes. All components blended well. The sample was allowed to cool to room temperature (75° F., 24° C.).

EXAMPLE 84

Solubility of Saturated Monomer (Stearic Acid) in Aliphatic Primary Amine (Primene 81R) and FAS 150

The sample was heated to 180° F. (82° C.) oven to help solubilize it.

70 wt.% 20 wt.% stearic acid in Primene 81R 30 wt. % FAS 150

| | |
|---|---|
| 5 g | 20 wt. % stearic acid in 80 wt. % Primene 81R |
| 2 g | FAS 150 solvent |

The sample was clear yellow and looked good.

EXAMPLE 85

Solubility of Saturated Monomer (Stearic Acid) in Aliphatic Primary Amine (Primene 81R), FAS 150 and Pripol 1009

| | |
|---|---|
| 28.0 g | FAS 150 added first |
| 38.4 g | Primene 81R added second |
| 9.6 g | Stearic acid added third |
| 24.0 g | Pripol 1009 dimer acid added fourth |
| 100 g | Total sample |

The sample mixed well at 75° F. (24° C.). Some heat was released. The sample was only stirred and not heated, and was clear yellow in color.

EXAMPLE 86

Solubility of Saturated Monomer (Stearic Acid) in Aliphatic Primary Amine (Primene 81R)

| | |
|---|---|
| 23.2 g | Stearic acid (58 wt. %) |
| 16.8 g | Primene 81R (42 wt. %) |
| 40.0 g | Total sample (100 wt. %) |

The sample mixed well at 75° F. (24° C.). There was still a little stearic acid undissolved on bottom of bottle. The sample was placed in a 180° F. (82° C.) oven overnight. All of the stearic acid dissolved. The sample was allowed to cool to room temperature (75° F., 24° C.) and the solutionl was still clear.

EXAMPLE 87

Solubility of Stearic Acid in Dicyclohexylamine

| | |
|---|---|
| 2 g | Stearic acid (10 wt. %) |
| 18 g | Dicyclohexylamine (90 wt. %) |
| 20 g | Total sample (100 wt. %) |

The sample did not mix well at 75° F. (24° C.) and was a cloudy white paste. When it was placed in a 180° F. (82° C.) oven, there was a distinct separation into two phases. When the sample was shaken, it turned cloudy again. After the sample was allowed to cool to 75° F. (24° C.), the two liquid phases appeared again and eventually the sample turned solid.

EXAMPLE 88

Solubility of Oleic Acid in Dimer Acid

| | |
|---|---|
| 10 g | Priolene 6933 Oleic acid (50 wt. %) |
| 10 g | Pripol 1009 (50 wt. %) |
| 20 g | Total sample (100 wt. %) |

The sample mixed well at room temperature (75° F., 24° C.) and after 24 hours the sample still looked good.

EXAMPLE 89

Solubility of Stearic Acid in Tri-N-butylamine

| | |
|---|---|
| 18 g | Stearic acid (90 wt. %) |
| 2 g | Tri-n-butylamine (10 wt. %) |
| 20 g | Total sample (100 wt. %) |

The sample mixed well at room temperature (75° F., 24° C.) into a clear, water white solution. After 5 days, however, the sample was cloudy.

EXAMPLE 90

Solubility of Stearic Acid in Primene 81R

| | |
|---|---|
| 2 g | Stearic acid (67 wt. %) |
| 1 g | Primene 81R (33 wt. %) |
| 3 g | Total sample (100 wt. %) |

The sample was heated to 180° F. (82° C.) to help solubilize the sample completely. The sample was allowed to cool to 75° F. (24° C.). The stearic acid dropped out and turned solid.

EXAMPLE 91

Solubility of Stearic Acid in Propoxylated Amine

| | |
|---|---|
| 1 g | Stearic acid (10 wt. %) |
| 9 g | Propomeen T/12 Propoxylated amine (90 wt. %) |
| 10 g | Total sample (100 wt. %) |

The sample was heated to 180° F. (82° C.) and allowed to cool to 75° F. (24° C.). The mixture resulted in a light yellow solid.

EXAMPLE 92

Solubility of Stearic Acid in Octylamine

| | |
|---|---|
| 1 g | Stearic acid (10 wt. %) |
| 9 g | Octylamine (90 wt. %) |
| 10 g | Total sample (100 wt. %) |

The sample solubilize easily at 75° F. (24° C.) and was clear, water white.

EXAMPLE 93

Solubility of Stearic Acid in Heterocyclic Amine

| | |
|---|---|
| 1 g | Stearic acid (10 wt. %) |
| 9 g | Amine CS 1246 heterocyclic amine (90 wt. %) |
| 10 g | Total sample (100 wt. %) |

The sample was a little hard to solubilized at 75° F. (24° C.). The sample was placed in a 180° F. (82° C.) oven which solubilized the stearic acid. After the sample cooled to 75° F. (24° C.), it had a clear, water white appearance.

EXAMPLE 94

Solubility of Stearic Acid in N,N-Diborylethylene Amine

| | |
|---|---|
| 1 g | Stearic acid (10 wt. %) |
| 9 g | N,N-Diborylethylene amine (98%) (90 wt. %) |
| 10 g | Total sample (100 wt. %) |

The sample dissolved at 75° F. (24° C.) into a clear white liquid.

EXAMPLE 95

Solubility of Stearic Acid in Ethoxylated Alkylamine

| | |
|---|---|
| 1 g | Stearic acid saturated monomer (10 wt. %) |
| 9 g | E-14-5 ethoxylated alkylamine (90 wt. %) sold by Tomah Chemical Co. |
| 10 g | Total sample (100 wt. %) |

The sample was a sticky, white material at 75° F. (24° C.). The sample was placed into a 180° F. (82° C.) oven, and then allowed to cool to 75° F. (24° C.), when it turned into a light brown solid.

EXAMPLE 96

Solubility of Stearic Acid in Ethoxylated Alkylamine

| | |
|---|---|
| 1 g | Stearic acid saturated monomer (10 wt. %) |
| 9 g | E-17-2 ethoxylated alkylamine (90 wt. %) sold by Tomah Chemical Co. |
| 10 g | Total sample (100 wt. %) |

The sample did not mix well at 75° F. (24° C.). The sample was placed into a 180° F. (82° C.) oven, and then allowed to cool to 75° F. (24° C.). The sample then had a clear, yellow appearance.

EXAMPLE 97

Solubility of Stearic Acid in Alkyl Pyridine

| | |
|---|---|
| 1 g | Stearic acid saturated monomer (10 wt. %) |
| 9 g | Alkyl pyridine (90 wt. %) sold by Reilly Chemical Co. |
| 10 g | Total sample (100 wt. %) |

The sample mixed well at 75° F. (24° C.) and appeared solubilized.

EXAMPLE 98

Solubility of Stearic Acid in Westvaco 1500

| | |
|---|---|
| 1 g | Stearic acid saturated monomer (10 wt. %) |
| 9 g | Westvaco 1500 unsaturated oligomeric fatty acid (90 wt. %) |
| 10 g | Total sample (100 wt. %) |

The sample was placed in a 180° F. (82° C.) oven, where it mixed well. It was allowed to cool to 75° F. (24° C.), whereupon it turned into a dark brown solid.

EXAMPLE 99

Solubility of PRIOLENE 6933 Oleic Acid in Westvaco 1500

| | |
|---|---|
| 10 g | PRIOLENE 6933 oleic acid (50 wt. %) |
| 10 g | Westvaco 1500 unsaturated oligomeric fatty acid (50 wt. %) |
| 20 g | Total sample (100 wt. %) |

The sample mixed well at 75° F. (24° C.).

EXAMPLE 100

Solubility of PRIOLENE 6933 Oleic Acid in PRIPOL 1009 Dimer Acid

| | |
|---|---|
| 10 g | PRIOLENE 6933 oleic acid (50 wt. %) |
| 10 g | PRIPOL 1009 Dimer Acid (50 wt. %) |
| 20 g | Total sample (100 wt. %) |

The sample mixed well at 75° F. (24° C.). It was a little viscous, but stayed mixed.

EXAMPLE 101

Solubility of Stearic Acid in Cyclohexylamine

| | |
|---|---|
| 1 g | Stearic acid (10 wt. %) |
| 9 g | Cyclohexylamine (90 wt. %) |
| 10 g | Total sample (100 wt. %) |

The sample was a cloudy paste at 75° F. (24° C.). It was placed in an oven at 180° F. (82° C.), whereupon the sample mixed well. It was then allowed to cool to 75° F. (24° C.), and it turned a solid light brown.

EXAMPLE 102

Solubility of Stearic Acid in N,N-Dimethylaniline

| | |
|---|---|
| 1 g | Stearic acid (10 wt. %) |
| 9 g | N,N-Dimethylaniline (99%) (90 wt. %) |
| 10 g | Total sample (100 wt. %) |

The sample did not mix well at 75° F. (24° C.). It was placed in an oven at 180° F. (82° C.), and when cooled, the product separated and formed light yellow crystals.

EXAMPLES 103–120

Solubility of Mixtures of a Synthetic Monomeric Acid With An Oligomeric Fatty Acid Using MX-Dimer available from Sylva Chemical Co., various samples were prepared which contained 30 wt. % Solvent 14, 38.5 wt. % dimer acid, and the remaining 31.5 wt. %., containing as much stearic acid as possible, cut with isostearic or xylylstearic acid, synthetic monomer acid components. The dimer acid is 1.28 times as much as the Solvent 14 amount; the dimer acid is 1.22 times as much as the other acid.

Example 103

| | | |
|---|---|---|
| Dimer acid | 20.07 g | This mixture was heated until liquid. |
| Solvent 14 | 15.67 g | It was allowed to cool, and it solidified. |
| Stearic acid | 16.51 g | |

Example 104

| | |
|---|---|
| Dimer acid | 23.32 g |
| Solvent 14 | 18.21 g |
| Stearic acid | 9.58 g |
| Isostearic acid | 9.62 g |

This mixture was heated until liquid. It was allowed to cool, and it solidified.

Example 105

| | |
|---|---|
| Dimer acid | 12.49 g |
| Solvent 14 | 9.79 g |
| Stearic acid | 5.14 g |
| Xylylstearic acid | 5.12 g |

This mixture was heated until liquid. It was allowed to cool, and it solidified.

Example 106

| | |
|---|---|
| Dimer acid | 16.55 g |
| Solvent 14 | 12.92 g |
| Stearic acid | 3.39 g |
| Isostearic add | 10.17 g |

This mixture was heated until liquid. It was allowed to cool overnight. Some precipitate was observed.

Example 107

| | | |
|---|---|---|
| Dimer acid | 14.83 g | 38.4 wt. % |
| Solvent 14 | 11.69 g | 30.1 wt. % |
| Stearic acid | 3.06 g | 7.9 wt. % |
| Xylylstearic acid | 9.19 g | 23.6 wt. % |

Overnight the mixture stayed clear. Some precipitate formed the next day.

TABLE VI

Solubility of Mixtures of a Synthetic Monomeric Acid with An Oligomeric Fatty Acid

| Ex. | 50 wt. % of material from | 50 wt. % of material from | Observations* |
|---|---|---|---|
| 108 | Ex. 105 | Ex. 107 | Rapid precipitate upon cooling - solid |
| 109 | Ex. 104 | Ex. 106 | Precipitate upon cooling - solid |
| 110 | Ex. 104 | Ex. 107 | Rapid precipitate upon cooling - fluid |
| 111 | Ex. 105 | Ex. 106 | Rapid precipitate upon cooling - fluid |
| 112 | Ex. 104 | Ex. 105 | Rapid precipitate upon cooling - solid |
| 113 | Ex. 106 | Ex. 107 | No precipitate, but one had formed two days later. |

*When the word "solid" was used, the entire mixture acted as a solid and was unpourable. When the word "liquid" was used, although a precipitate had formed, the mixture was a pourable fluid mixture.

| | |
|---|---|
| Dimer acid | 38.5 wt. % |
| Solvent 14 | 30.0 wt. % |
| Stearic acid | 7.9 wt. % |
| Isostearic acid | 11.8 wt. % |
| Xylylstearic acid | 11.8 wt. % |
| EY706 | one drop |

TABLE VII

Solubility of Mixtures of a Synthetic Monomeric Acid with An Oligomeric Fatty Acid

| Ex. | 2 g of | Additive Quantity | Additive | Observations |
|---|---|---|---|---|
| 114 | Ex. 103 | 1 drop | EY706 | Solid with white chunks |
| 115 | Ex. 104 | 1 scoop* | T-3792 | Uniform solid |
| 116 | Ex. 107 | 1 drop | EY706 | |
| 117 | Ex. 107 | 1 scoop | T-3792 | Cloudy |

TABLE VII-continued

Solubility of Mixtures of a Synthetic Monomeric Acid with An Oligomeric Fatty Acid

| Ex. | 2 g of | Additive Quantity | Additive | Observations |
|---|---|---|---|---|
| 118 | Ex. 106 | 1 drop | EY706 | |
| 119 | Ex. 106 | 1 scoop | T-3792 | Cloudy |

*A scoop is defined as a small amount of solid additive on the end of a small spatula.

Composition of Example 120

| | |
|---|---|
| Dimer acid | 38.5 wt. % |
| Solvent 14 | 30.0 wt. % |
| Oleic acid (Pamolyn 100 supplied by Arizona Chemical) | 31.5 wt. % |

This composition of Example 122 was liquid and remained liquid.

Composition of Example 121

| | |
|---|---|
| Solvent 14 | 30.0 wt. % |
| Xylylstearic acid | 70.0 wt. % |

This composition of Example 121 was liquid and remained liquid.

Composition of Example 122

| | |
|---|---|
| Dimer acid | 38.5 wt. % |
| Solvent 14 | 30.0 wt. % |
| Xylylstearic acid | 31.5 wt. % |

This composition of Example 122 was liquid and remained liquid.

EXAMPLES 123–172

Various other blends and mixtures within the scope of this invention were used in Examples 165–172 as contrasted with comparative Examples 123–164 using various components singly, or various commercial lubricity additives, with the results reported in Table VIII. The lubricity additives were tested in NARL Blend #1 Fuel (Eastern Canadian Blend).

Wear Scar data was obtained using ASTM-6079 HFRR. As can be seen in Table VIII, the wear scar data obtained using the inventive compositions of Examples 165–172 was better than that obtained using conventional lubricity additives, or the fatty acid components singly.

TABLE VIII

Lubricity Additives in NARL Blend #1 Fuel (Eastern Canadian Blend)

| Ex. | Additive | Chemical Name | ppm | Wear Scar, μm | Av. Film (%) | Av. Friction Coefficient |
|---|---|---|---|---|---|---|
| 123 | Blank | — | — | 602 | 21 | 0.393 |
| 124 | Akzo Neo-Fat 94-06 | Oleic acid | 1000 | 233 | 89 | 0.106 |
| 125 | Akzo Neo-Fat 94-06 | Oleic acid | 100 | 399 | 59 | 0.178 |
| 126 | Westvaco DTC-595 | Dimer acid | 100 | 344 | 73 | 0.185 |
| 127 | Westvaco M28 | Mixed dimer/Rosin acids | 100 | 359 | 70 | 0.176 |
| 128 | M-1849 | Tetrapropenyl succinic acid | 100 | 568 | 9 | 0.298 |
| 129 | Westvaco 1500 | Dimer acid | 100 | 358 | 79 | 0.173 |

TABLE VIII-continued

Lubricity Additives in NARL Blend #1 Fuel (Eastern Canadian Blend)

| Ex. | Additive | Chemical Name | ppm | Wear Scar, μm | Av. Film (%) | Av. Friction Coefficient |
|---|---|---|---|---|---|---|
| 130 | Arizona FA-2 | Tall oil fatty acid | 100 | 346 | 69 | 0.157 |
| 131 | Westvaco Rosin R | Rosin acid | 100 | 236 | 87 | 0.169 |
| 132 | Aldrich Stearic Acid | Stearic acid | 100 | 437 | 65 | 0.159 |
| 133 | Union Camp Unitol PDT | Mixed monomer/dimer acids | 100 | 449 | 76 | 0.170 |
| 134 | Union Camp Century MO-5 | Mixed monomer acids | 100 | 367 | 71 | 0.162 |
| 135 | Unichema Pripol 1013 | Distilled dimer acid | 100 | 324 | 84 | 0.170 |
| 136 | Xylylstearic Acid | Xylylstearic acid | 100 | 300 | 84 | 0.171 |
| 137 | Unichema Pripol 1040 | Trimer acid | 100 | 396 | 80 | 0.196 |
| 138 | Westvaco OCD-128 | Mixed monomer acids | 100 | 294 | 84 | 0.161 |
| 139 | Unichema Palmitic Acid | Palmitic acid | 100 | 338 | 73 | 0.157 |
| 140 | Westvaco 1550 | Dimer acid | 100 | 441 | 72 | 0.179 |
| 141 | Union Camp Century D-75 | Mixed monomer/dimer acids | 100 | 362 | 78 | 0.179 |
| 142 | Union Camp Century 1164 | Mixed monomer acids | 100 | 421 | 67 | 0.170 |
| 143 | Unichema Lauric Acid | Lauric acid | 100 | 397 | 70 | 0.161 |
| 144 | Unichema Behenic Acid | Behenic acid | 100 | 390 | 74 | 0.157 |
| 145 | Westvaco DTC-155 | Mixed monomer/dimer acids | 100 | 377 | 66 | 0.176 |
| 146 | Westvaco M-15 | Mixed dimer/Rosin acids | 100 | 339 | 79 | 0.162 |
| 147 | 50% Rosin R | Rosin acid in solvent | 200 | 354 | 71 | 0.184 |
| 148 | Unichema Pripol 1009 | Distilled dimer acid | 100 | 366 | 70 | 0.185 |
| 149 | Unichema Pripol 1040 | Trimer acid | 100 | 537 | 19 | 0.286 |
| 150 | Westvaco OCD-128 | Mixed monomer acids | 100 | 341 | 71 | 0.167 |
| 151 | Unichema Pripol 1013 | Distilled dimer acid | 100 | 341 | 73 | 0.180 |
| 152 | Xylylstearic acid | Xylylstearic acid | 100 | 349 | 60 | 0.184 |
| 153 | Aldrich Stearic Acid | Stearic acid | 100 | 385 | 62 | 0.156 |
| 154 | CRO-290 | Imidazoline salt | 100 | 451 | 46 | 0.214 |
| 155 | 25% Westvaco Rosin R | Rosin acid | 400 | 373 | 68 | 0.189 |
| 156 | Unichema Priolene 6900 | Oleic acid | 100 | 363 | 69 | 0.169 |
| 157 | Westvaco L-5 | Tall oil fatty acid | 100 | 312 | 80 | 0.155 |
| 158 | Westvaco L-1 | Tall oil fatty acid | 100 | 304 | 79 | 0.155 |
| 159 | Westvaco DTC-195 | Trimer acid | 100 | 315 | 79 | 0.185 |
| 160 | CRO-4080 | Tall oil fatty acid anhydride ester | 333 | 376 | 71 | 0.199 |
| 161 | Tolad 9103 | Mixed monomer/dimer acids | 100 | 361 | 67 | 0.178 |
| 162 | Tolad 9103 | Mixed monomer/dimer acids | 50 | 566 | 13 | 0.284 |
| 163 | Tolad 9103 | Mixed monomer/dimer acids | 75 | 320 | 81 | 0.179 |
| 164 | Tolad 9103 | Mixed monomer/dimer acids | 60 | 512 | 32 | 0.244 |
| 165 | 75% 50:50 Pripol 1009/L-5 | Blend | 60 | 428 | 58 | 0.205 |
| 166 | 75% 50:50 DTC-195/L-5 | Blend | 60 | 496 | 34 | 0.231 |
| 167 | 75% 50:50 Pripol 1009/Century 1105 | Blend | 60 | 236 | 88 | 0.162 |
| 168 | 75% 50:50 DTC-195/Century 1105 | Blend | 60 | 378 | 72 | 0.192 |
| 169 | 75% 65:10 Pripol 1009/Palmitic acid | Blend | 60 | 274 | 85 | 0.163 |
| 170 | 75% 65:10 DTC-195/Palmitic acid | Blend | 60 | 382 | 66 | 0.197 |
| 171 | 75% 65:10 DTC-595/Palmitic acid | Blend | 60 | 363 | 75 | 0.186 |
| 172 | 75% 44:31 Stearic acid/Primene 81R | Blend | 60 | 299 | 85 | 0.163 |

In the foregoing specification, the invention has been described with reference to specific embodiments thereof, and has been demonstrated as effective for improving the lubricity of fuels. However, it will be evident that various modifications and changes can be made thereto without departing from the broader spirit or scope of the invention as set forth in the appended claims. Accordingly, the specification is to be regarded in an illustrative rather than a restrictive sense. For example, specific combinations of monomeric fatty acids and oligomeric fatty acids and optional amines falling within the claimed parameters, but not specifically identified or tried in a particular composition to improve the lubricity of fuels herein, are anticipated to be within the scope of this invention.

It is anticipated that the compositions of this invention will also impart to the engines in which they are used as fuel lubricity aids, greater horsepower, lower emissions and better fuel economy as a result of less friction, whether they are used in diesel or gasoline engines.

GLOSSARY

| | |
|---|---|
| 1500 | Dimer acid available from Westvaco. |
| AEAE | Aminoethylaminoethanol or 2-(2-aminoethyl-amino)-ethanol. |
| Amine CS 1246 | A heterocyclic amine sold by Angus Chemical Co. |
| Century 1105 | Synthetic, saturated monomer acid available from Union Camp. |
| Century 1164 | Mixed monomer acids available from Union Camp. |
| Century D-75 | Mixed monomer/dimer acids available from Union Camp. |
| Century MO-5 | Mixed monomer acids available from Union Camp. |
| CRO-111 | Fatty acid imidazoline sold by Baker Petrolite. |
| CRO-290 | Isostearic acid imidazoline sold by Baker Petrolite. |
| CRO-4080 | Tall oil fatty acid anhydride ester sold by Baker Petrolite. |
| CS1246 ® | A heterocyclic amine sold by Angus Chemical Company. |
| DEA | Diethanolamine. |

-continued

| GLOSSARY | |
|---|---|
| DTC-155 | Mixed monomer/dimer acids available from Westvaco. |
| DTC-195 | Trimer acids available from Westvaco. |
| DTC-595 | Dimer acid available from Westvaco. |
| EXXATE ® 1300 Solvent | A saturated ester sold by Exxon Chemical. |
| EY702 | An ethylene/vinyl acetate copolymer sold by Quantum Chemical Co. |
| FA-2 | Tall oil fatty acid available from Arizona Chemical. |
| FAS ® 150 | A heavy aromatic naphtha supplied by Fina. |
| Hamposil C | A cocoamine derivative of sarcosine (forming an aminoacid) sold by Hampshire Chemical Co. |
| Hamposil O | An oleylamine derivative of sarcosine (forming an aminoacid) sold by Hampshire Chemical Co. |
| HOAc | Acetic acid (glacial). |
| L-5 | Tall oil fatty add sold by Westvaco. |
| M-15 | Mixed dimer acid/rosin acids available from Westvaco. |
| M-28 | Mixed dimer acid/rosin acids available from Westvaco. |
| M-1849 | Tetrapropenyl succinic acid available from Baker Petrolite. |
| Neo-Fat 94-06 | Oleic acid available from Akzo. |
| OCD-128 | Mixed monomer acids available from Westvaco. |
| PRIMENE 81R ® | An aliphatic $C_{12-14}$ primary amine sold by Rohm & Haas. |
| PRIOLENE ® 6900 | Oleic acid sold by Unichemica |
| PRIOLENE ® 6933 | Oleic acid sold by Unichemica |
| PRIPOL ® 1009 | A hydrogenated dimer acid sold by Unichemica. |
| PRIPOL ® 1013 | Distilled dimer acid sold by Unichemica. |
| PRIPOL ® 1040 | Trimer acid sold by Unichemica. |
| PROPOMEEN ® T/12 | A propoxylated amine sold by Akzo Chemical |
| Rosin R | Rosin acid available from Westvaco. |
| SW-1 | Swedish Class 1 diesel fuel - a test fuel. |
| T-3972 | TOLAD ® 3792; an ester of an olefin/maleic anhydride copolymer sold by Baker Petrolite Corporation. |
| TOLAD ® 9103 | A commercial lubricity aid sold by Baker Petrolite Corporation, which is a complex mixtures of saturated and unsaturated monomeric fatty acids and oligomers having about 3.8% of stearic acid. |
| TOMAH E-17-2 ® | A oxyalkylated amine sold by Tomah Chemical Company. |
| Unitol PDT | Mixed monomer/dimer acids available from Union Camp. |
| Westvaco 1500 | An unsaturated oligomeric fatty acid sold by Westvaco. |
| WITCAMIDE ® 5138 | Alkanolamide from oleic acid and monoethanolamine. |

We claim:

1. A composition for improving the lubricity of distillate fuels comprising:

(a) at least one monomeric fatty acid component selected from the group consisting of a saturated, monomeric fatty acid having from 12 to 22 carbon atoms;

an unsaturated, monomeric fatty acid having from 12 to 22 carbon atoms; and a synthetic monomeric acid having from 12 to 40 carbon atoms; and (b) at least one oligomeric fatty acid component selected from the group consisting of a saturated, oligomeric fatty acid having from 24 to 66 carbon atoms; and an unsaturated, oligomeric fatty acid having from 24 to 66 carbon atoms excluding a mixture of a saturated, monomeric fatty acid having from 12 to 22 carbon atoms with an unsaturated, monomeric fatty acid having from 12 to 22 carbon atoms; and a mixture of a saturated, oligomeric fatty acid having from 24 to 66 carbon atoms with an unsaturated, oligomeric fatty acid having from 24 to 66 carbon atoms.

2. The composition for improving the lubricity of distillate fuels of claim 1 where the monomeric fatty acid component (a) comprises from about 4 to 90 wt. % of the total composition.

3. The composition for improving the lubricity of distillate fuels of claim 1 where the monomeric fatty acid component (a) comprises a saturated, monomeric fatty acid and the composition additionally comprises an amine.

4. The composition of claim 3 where the amine is selected from the group consisting of tertiary amines and amines where the carbon adjacent the amine nitrogen contains no hydrogen atoms.

5. The composition of claim 3 where the amine is selected from the group consisting of primary aliphatic amines, secondary aliphatic amines, tertiary aliphatic amines, cycloaliphatic amines, heterocyclic amines, aromatic amines and oxyalkylated amines.

6. The composition of claim 3 where the molar equivalent proportion of amine to saturated, monomeric fatty acid (a) in the total composition ranges from about 0.1:1 to about 1:1.

7. The composition for improving the lubricity of distillate fuels of claim 1 further comprising an aromatic solvent.

8. The composition for improving the lubricity of distillate fuels of claim 7 where the proportion of aromatic solvent in the total composition ranges up to 50 wt. %.

9. A distillate fuel having improved lubricity comprising:

(A) a hydrocarbon selected from the group consisting of diesel fuel, kerosene, and gasoline; and (B) a composition for improving the lubricity of the fuel comprising:

(a) a monomeric fatty acid component selected from the group consisting of a saturated, monomeric fatty acid having from 12 to 22 carbon atoms;

an unsaturated, monomeric fatty acid having from 12 to 22 carbon atoms; and a synthetic monomeric acid having from 12 to 40 carbon atoms; and (b) an oligomeric fatty acid component selected from the group consisting of a saturated, oligomeric fatty acid having from 24 to 66 carbon atoms; and an unsaturated, oligomeric fatty acid having from 24 to 66 carbon atoms excluding a mixture of a saturated, monomeric fatty acid having from 12 to 22 carbon atoms with an unsaturated, monomeric fatty acid having from 12 to 22 carbon atoms; and a mixture of a saturated, oligomeric fatty acid having from 24 to 66 carbon atoms with an unsaturated, oligomeric fatty acid having from 24 to 66 carbon atoms.

10. The distillate fuel of claim 9 where the proportion of the composition for improving the lubricity of the fuel (B) in the total hydrocarbon fuel ranges from 10 to 400 ppm.

11. The distillate fuel of claim 9 where in the composition for improving the lubricity of fuel (B) the monomeric fatty acid component (a) comprises from about 4 to 90 wt. % of the total composition.

12. The distillate fuel of claim 9 where in the composition for improving the lubricity of fuel (B) the monomeric fatty acid component (a) comprises a saturated, monomeric fatty acid and the composition additionally comprises an amine.

13. The distillate fuel of claim 12 where the amine is selected from the group consisting of tertiary amines and amines where the carbon adjacent the amine nitrogen contains no hydrogen atoms.

14. The distillate fuel of claim 12 where in the composition for improving the lubricity of fuel (B) further comprises an amine having at least one amine functional group selected from the group consisting of primary aliphatic amines, secondary aliphatic amines, tertiary aliphatic amines, cycloaliphatic amines, heterocyclic amines, aromatic amines and oxyalkylated amines.

15. The distillate fuel of claim 12 where in the composition for improving the lubricity of fuel (B) the molar equivalent proportion of amine to saturated, monomeric fatty acid component (a) in the total composition ranges from about 0.1:1 to about 1:1.

16. The distillate fuel of claim 9 where in the composition for improving the lubricity of fuel (B), the composition further comprises an aromatic solvent.

17. The distillate fuel of claim 16 where in the composition for improving the lubricity of fuel (B) the proportion of aromatic solvent in the total composition ranges up to 50 wt. %.

18. A composition for improving the lubricity of distillate fuels selected from the group consisting essentially of:

(1) a mixture comprising at least one saturated, monomeric $C_{12}$–$C_{22}$ fatty acid and at least one saturated, oligomeric $C_{24}$–$C_{66}$ fatty acid;

(2) a mixture comprising at least one saturated, monomeric $C_{12}$–$C_{22}$fatty acid and at least one unsaturated, oligomeric $C_{24}$–$C_{66}$ fatty acid;

(3) a mixture comprising at least one unsaturated, monomeric $C_{12}$–$C_{22}$ fatty acid and at least one saturated, oligomeric $C_{24}$–$C_{66}$ fatty acid;

(4) a mixture comprising at least one unsaturated, monomeric $C_{12}$–$C_{22}$ fatty acid and at least one unsaturated, oligomeric $C_{24}$–$C_{66}$ fatty acid;

(5) a mixture comprising at least one synthetic monomeric $C_{12}$–$C_{40}$ fatty acid and at least one saturated or unsaturated, oligomeric $C_{24}$–$C_{66}$ fatty acid; and (6) a mixture comprising at least one saturated, monomeric $C_{12}$–$C_{22}$ fatty acid and at least one amine, where the amine is selected from the group consisting of a tertiary amine and an amine where the carbon adjacent the amine nitrogen contains no hydrogen atoms.

19. The composition for improving the lubricity of distillate fuels of claim 18 where the acids are pure.

20. The composition for improving the lubricity of distillate fuels of claim 18 where the monomeric fatty acid comprises from about 4 to 90 wt. % of the total composition.

21. The composition for improving the lubricity of distillate fuels of claim 20 where in mixture (6) the molar equivalent proportion of amine to saturated, monomeric fatty acid (a) in the total composition ranges from about 0.1:1 to about 1:1.

22. The composition for improving the lubricity of distillate fuels of claim 18 where each mixture (1)–(6) further comprises an aromatic solvent.

23. A method of improving the lubricity of a distillate fuel comprising:

(A) providing a hydrocarbon selected from the group consisting of diesel fuel, kerosene, and gasoline; and (B) adding to the hydrocarbon an amount of a composition effective for improving the lubricity of the fuel, said composition comprising:

(a) at least one monomeric fatty acid component selected from the group consisting of a saturated, monomeric fatty acid having from 12 to 22 carbon atoms;

an unsaturated, monomeric fatty acid having from 12 to 22 carbon atoms; and a synthetic monomeric acid having from 12 to 40 carbon atoms; and (b) at least one oligomeric fatty acid component selected from the group consisting of a saturated, oligomeric fatty acid having from 24 to 66 carbon atoms; and an unsaturated, oligomeric fatty acid having from 24 to 66 carbon atoms excluding a mixture of a saturated, monomeric fatty acid having from 12 to 22 carbon atoms with an unsaturated, monomeric fatty acid having from 12 to 22 carbon atoms;

a mixture of a saturated, oligomeric fatty acid having from 24 to 66 carbon atoms with an unsaturated, oligomeric fatty acid having from 24 to 66 carbon atoms.

24. The method of claim 23 where in the adding (B), the proportion of the composition for improving the lubricity of the fuel in the total distillate fuel ranges from 10 to 400 ppm.

25. The method of claim 23 where in the adding (B), in the composition, the monomeric fatty acid component (a) comprises from about 4 to 90 wt. % of the total composition for improving the lubricity of the fuel.

26. The method of claim 23 where in the adding (B), in the composition for improving the lubricity of distillate fuels the monomeric fatty acid component (a) comprises a saturated, monomeric fatty acid and the composition additionally comprises an amine.

27. The method of claim 26 where the amine is selected from the group consisting of tertiary amines and amines where the carbon adjacent the amine nitrogen contains no hydrogen atoms.

28. The method of claim 26 where the amine is selected from the group consisting of primary aliphatic amines, secondary aliphatic amines, tertiary aliphatic amines, cycloaliphatic amines, heterocyclic amines, aromatic amines and oxyalkylated amines.

29. The method of claim 26 where the molar equivalent proportion of amine to saturated, monomeric fatty acid (a) in the total composition ranges from about 0.1:1 to about 1:1.

30. The method of claim 23 where in the adding (B), in the composition for improving the lubricity of distillate fuels, the composition further comprises an aromatic solvent.

31. The method of claim 30 where the proportion of aromatic solvent in the total composition ranges up to 50 wt. %.

32. A method of operating a compression-ignition engine comprising providing a hydrocarbon fuel of claim 1 as the fuel in the engine to control wear and improve lubricity in a fuel injection system of the engine.

33. A composition for improving the lubricity of distillate fuels comprising:

(a) only pure one monomeric fatty acid component selected from the group consisting of a saturated, monomeric fatty acid having from 12 to 22 carbon atoms;

an unsaturated, monomeric fatty acid having from 12 to 22 carbon atoms; and a synthetic monomeric acid having from 12 to 40 carbon atoms; and (b) only one pure oligomeric fatty acid component selected from the group consisting of a saturated, oligomeric fatty acid having from 24 to 66 carbon atoms; and an unsaturated, oligomeric fatty acid having from 24 to 66 carbon atoms.

excluding a mixture of a saturated, monomeric fatty acid having from 12 to 22 carbon atoms with an unsaturated, monomeric fatty acid having from 12 to 22 carbon atoms;

a mixture of a saturated, oligomeric fatty acid having from 24 to 66 carbon atoms with an unsaturated, oligomeric fatty acid having from 24 to 66 carbon atoms.

34. The composition for improving the lubricity of distillate fuels of claim 33 where the one pure monomeric fatty acid component (a) comprises from about 4 to 90 wt. % of the total composition.

35. The composition for improving the lubricity of distillate fuels of claim 33 the one pure monomeric fatty acid component (a) comprises a saturated, monomeric fatty acid and the composition additionally comprises an amine.

36. The composition of claim 35 where the amine is selected from the group consisting of tertiary amines and amines where the carbon adjacent the amine nitrogen contains no hydrogen atoms.

37. The composition of claim 35 where the amine is selected from the group consisting of primary aliphatic amines, secondary aliphatic amines, tertiary aliphatic amines, cycloaliphatic amines, heterocyclic amines, aromatic amines and oxyalkylated amines.

38. The composition of claim 35 where the molar equivalent proportion of amine to the one pure saturated, monomeric fatty acid (a) in the total composition ranges from about 0.1:1 to about 1:1.

39. The composition for improving the lubricity of distillate fuels of claim 33 further comprising an aromatic solvent.

40. The composition for improving the lubricity of distillate fuels of claim 39 where the proportion of aromatic solvent in the total composition ranges up to 50 wt. %.

41. A composition for improving the lubricity of distillate fuels comprising:

(a) at least one monomeric fatty acid component selected from the group consisting of a saturated, monomeric fatty acid having from 12 to 22 carbon atoms;

an unsaturated, monomeric fatty acid having from 12 to 22 carbon atoms; and a synthetic monomeric acid having from 12 to 40 carbon atoms; and (b) an amine is selected from the group consisting of a tertiary amine and an amine where the carbon adjacent the amine nitrogen contains no hydrogen atoms excluding a mixture of a saturated, monomeric fatty acid having from 12 to 22 carbon atoms with an unsaturated, monomeric fatty acid having from 12 to 22 carbon atoms; and a mixture of a saturated, oligomeric fatty acid having from 24 to 66 carbon atoms with an unsaturated, oligomeric fatty acid having from 24 to 66 carbon atoms.

42. The composition for improving the lubricity of fuels of claim 41 where the molar equivalent proportion of amine (b) to monomeric fatty acid component (a) in the total composition ranges from about 0.1:1 to about 1:1.

43. The composition for improving the lubricity of fuels of claim 41 further comprising an aromatic solvent.

44. The composition for improving the lubricity of fuels of claim 43 where the proportion of aromatic solvent in the total composition ranges up to 50 wt. %.

45. A composition for improving the lubricity of distillate fuels selected from the group consisting essentially of:

(1) a mixture consisting essentially of at least one saturated, monomeric $C_{12}$–$C_{22}$ fatty acid and at least one saturated, oligomeric $C_{24}$–$C_{66}$ fatty acid;

(2) a mixture consisting essentially of at least one saturated, monomeric $C_{12}$–$C_{22}$ fatty acid and at least one unsaturated, oligomeric $C_{24}$–$C_{66}$ fatty acid;

(3) a mixture consisting essentially of at least one unsaturated, monomeric $C_{12}$–$C_{22}$ fatty acid and at least one saturated, oligomeric $C_{24}$–$C_{66}$ fatty acid;

(4) a mixture consisting essentially of at least one unsaturated, monomeric $C_{12}$–$C_{22}$ fatty acid and at least one unsaturated, oligomeric $C_{24}$–$C_{66}$ fatty acid;

(5) a mixture consisting essentially of at least one synthetic monomeric $C_{12}$–$C_{40}$ fatty acid and at least one saturated or unsaturated, oligomeric $C_{24}$–$C_{66}$ fatty acid; and (6) a mixture consisting essentially of at least one saturated, monomeric $C_{12}$–$C_{22}$ fatty acid and at least one amine, where the amine is selected from the group consisting of a tertiary amine and an amine where the carbon adjacent the amine nitrogen contains no hydrogen atoms.

* * * * *